US005516025A

United States Patent [19]

Eriksson

[11] Patent Number: 5,516,025

[45] Date of Patent: May 14, 1996

[54] STAPLER HAVING A CLINCHING MECHANISM

[75] Inventor: Stig Eriksson, Hestra, Sweden

[73] Assignee: Isaberg AB, Hestra, Sweden

[21] Appl. No.: 362,419

[22] PCT Filed: Apr. 5, 1993

[86] PCT No.: PCT/SE93/00286

§ 371 Date: Dec. 28, 1994

§ 102(e) Date: Dec. 28, 1994

[87] PCT Pub. No.: WO94/00277

PCT Pub. Date: Jan. 6, 1994

[30] Foreign Application Priority Data

Jun. 30, 1992 [SE] Sweden ..... 9202007-2

[51] Int. Cl.[6] ..... B25C 7/00; B25C 5/02

[52] U.S. Cl. ..... 227/155

[58] Field of Search ..... 227/155, 19, 29, 227/84, 85, 154, 156

[56] References Cited

U.S. PATENT DOCUMENTS

| | | | |
|---|---|---|---|
| 1,169,339 | 1/1916 | Maynard . | |
| 1,612,870 | 1/1927 | Leschhorn . | |
| 2,987,729 | 6/1961 | Taynton | 227/155 |
| 4,087,034 | 5/1978 | Kikkawa et al. | 227/155 X |
| 4,378,085 | 3/1983 | McVeigh | 227/155 X |
| 4,449,661 | 5/1984 | Spehrley, Jr. | 227/155 |
| 4,593,847 | 6/1986 | Hagemann | 227/155 |
| 5,004,142 | 4/1991 | Olesen | 227/155 |

FOREIGN PATENT DOCUMENTS

WO90/08015 7/1990 WIPO .

*Primary Examiner*—Scott A. Smith
*Assistant Examiner*—Jay A. Stelacone
*Attorney, Agent, or Firm*—Shapiro and Shapiro

[57] ABSTRACT

A stapler for driving staples (2) into an object (3) has a drive element (1) for pushing a U-shaped staple (2) out of a magazine (10) to drive its legs (2*a*) through the object. The stapler also has an anvil device (11) comprising two anvil members (4) which are substantially symmetrically arranged with respect to the staple (2) driven into the object, and which are each pivotable about an axis (5) substantially perpendicular to the plane of the staple, the anvil members (4) being pivotable between a starting position, in which they are so positioned that the free leg ends of the staple (2) will engage the respective anvil member when the staple is driven into the object, and an end position, in order, when pivoting from the starting position to the end position, to bend the projecting end portions of the staple legs (2*a*) driven through the object (3), against the object in a direction towards each other. The axis (5) of each anvil member (4) is so located that the anvil member, when pivoting from the starting position to the end position, is swung towards the other anvil member at the side of the anvil axis (5) facing the staple (2).

11 Claims, 2 Drawing Sheets

STAPLER HAVING A CLINCHING MECHANISM

BACKGROUND OF THE INVENTION

The present invention relates to a stapler for driving staples into an object, such as a bundle of paper sheets, said stapler having a frame, a magazine arranged in the frame and containing substantially U-shaped staples, and a drive element adapted to push a staple out of the magazine and drive its legs through the object.

Prior-art staplers have a fixed anvil which is so positioned that the free leg ends of a staple discharged from the magazine will strike, when the staple is driven into the object, against the anvil which then bends the staple legs driven through the object, against the object in a direction towards each other. The staple thus bent exhibits, in the bent portion of each leg, a curve or bulge making the staple considerably thicker at its ends, as seen in the driving-in direction of the staple, than in its central portion where the staple legs engage the rear side of the object. Such a thickness increase is of course not desirable. For example, it is inconvenient when several bundles of an optional number of paper sheets stapled together are inserted in a binder, since the thickness of the collected bundle becomes considerably greater at the upper left-hand corner where the staples are usually placed when stapling paper sheets.

To overcome this problem, it has been proposed to replace the fixed anvil with a clinching mechanism which bends (clinches) the staples in such a manner that they will have a uniform thickness over their entire length. Known clinching mechanisms rely on one movable anvil member for each staple leg.

A known clinching mechanism will now be described with reference to FIG. 1, illustrating only those parts of a known stapler which are essential to the present description. In FIG. 1, the stapler is shown in a position in which its drive element 1 is driving a U-shaped staple 2 into a bundle 3 of paper sheets placed in the stapler. The clinching mechanism of the stapler comprises two anvil members 4 which are arranged substantially symmetrically with respect to the staple 2 and which each cooperate with one leg 2*a* of the staple 2. Each anvil member 4 is pivotable about a shaft or pin 5 perpendicular to the plane of the staple 2. As illustrated, the shafts 5 are disposed in the upper portion of the anvil members 4 on each side of the staple 2, i.e. outside its legs 2*a*. When the staple 2 is driven into the bundle 3 of paper sheets, its free leg ends will encounter, as shown, an oblique surface 6 of the respective anvil member 4, such that the legs 2*a* are bent slightly inwards, as the staple 2 is driven further into the bundle 3.

When the staple 2 has been driven completely into the bundle 3 of paper sheets, i.e. when its web portion engages the top side of the bundle, the anvil members 4 are pivoted by means of an operating slide 7, which is moved upwards, about the shafts 5 in the direction of the arrows indicated within the anvil members, to bend the legs 2*a* of the staple 2 into abutment against the underside of the paper bundle 3. In this manner, the staple 2 will be bent without any thickened portions of the type described above occurring at the ends of the bent staple.

Clinching mechanisms of this type are disclosed, e.g. in WO 90/08015, U.S. Pat. No. 4,593,847 and U.S. Pat. No. 4,449,661.

Since, as is often the case, the motion of the operating slide 7 is synchronised with the motion of other components, such as the drive element, included in the stapler, and the slide 7 therefore is mechanically connected to these components, it is difficult to design the clinching mechanism of FIG. 1 in such a manner that the upward displacement of the slide 7 stops in a well-defined turning position, which is necessary for achieving optimum bending results. The difficulties in this respect are caused by tolerance variations of the different components, and by the components "settling" when the stapler has been used for some time.

SUMMARY OF THE INVENTION

The object of the present invention therefore is to provide a stapler having a clinching mechanism, by means of which this problem can be easily overcome and by means of which so-called post-compression, reducing the spring-back of the staple legs after bending, can be done close to the ends of the bent staple and, hence, becomes more effective.

According to the present invention, this object is achieved by means of a stapler for driving staples into an object, such as a bundle of paper sheets, said stapler having a frame, a magazine arranged in the frame and containing staples, a drive element adapted to push a substantially U-shaped staple out of the magazine to drive its legs through the object, and an anvil device having two anvil members which are arranged substantially symmetrically with respect to the staple driven into the object, and which are each pivotable about an axis substantially perpendicular to the plane of the staple, said anvil members being pivotable between a starting position, in which they are so positioned that the free leg ends of the staple will engage the respective anvil member when the staple is driven into the object, and an end position, in order, when pivoting from the starting position to the end position, to bend the projecting end portions of the staple legs driven through the object, against the object in a direction towards each other, said stapler being characterised in that the axis of each anvil member is so positioned that the anvil member, when pivoting from the starting position to the end position, is swung towards the other anvil member at the side of the anvil axis facing the staple.

When the anvil members are each pivotable about one axis, the distance between the anvil axes is preferably less than or equal to the distance between the legs of the staple, and when the anvil members are pivotable about a common axis, this axis is preferably located midway between the legs of the staple driven in.

In a preferred embodiment, the anvil members are pivotable from the starting position to the end position by operating means cooperating with a first cam provided on the respective anvil member. The anvil members may also be pivotable from the end position to the starting position by said operating means which then also cooperates with a second cam provided on the respective anvil member. Alternatively, resilient means may be provided for urging the anvil members to the starting position, which is defined for each of the anvil members by a stop lug, against which the anvil member abuts in the starting position.

BRIEF DESCRIPTION OF THE DRAWINGS

The invention will now be described in more detail with reference to the accompanying drawings, in which.

DESCRIPTION OF THE PREFERRED EMBODIMENTS

Figure 1:
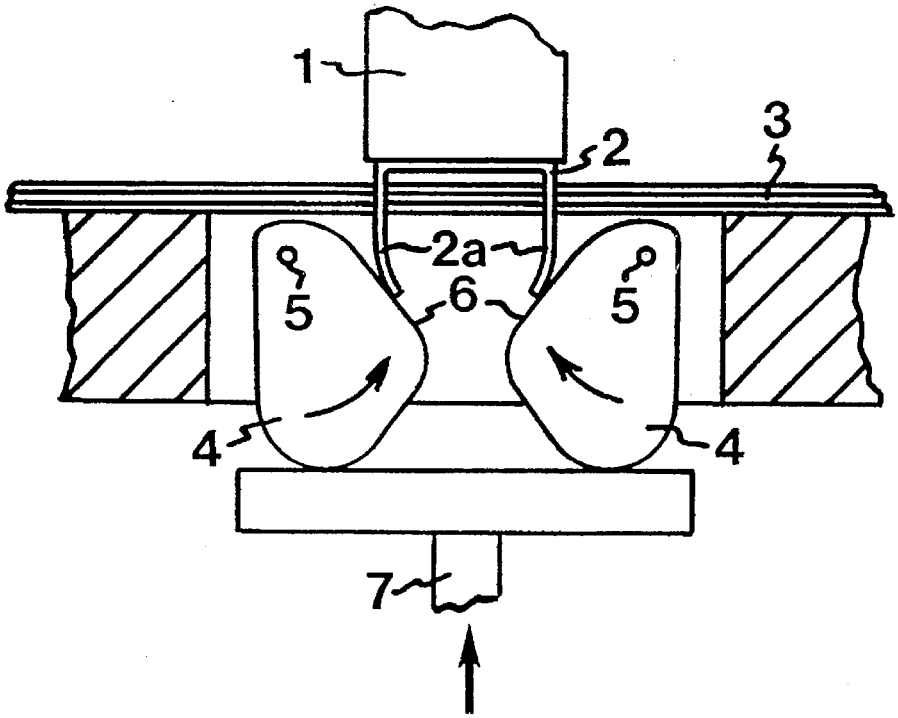
FIG.1 PRIOR ART
FIG. 1 shows parts of a stapler equipped with the clinching mechanism described above.
Figure 2:
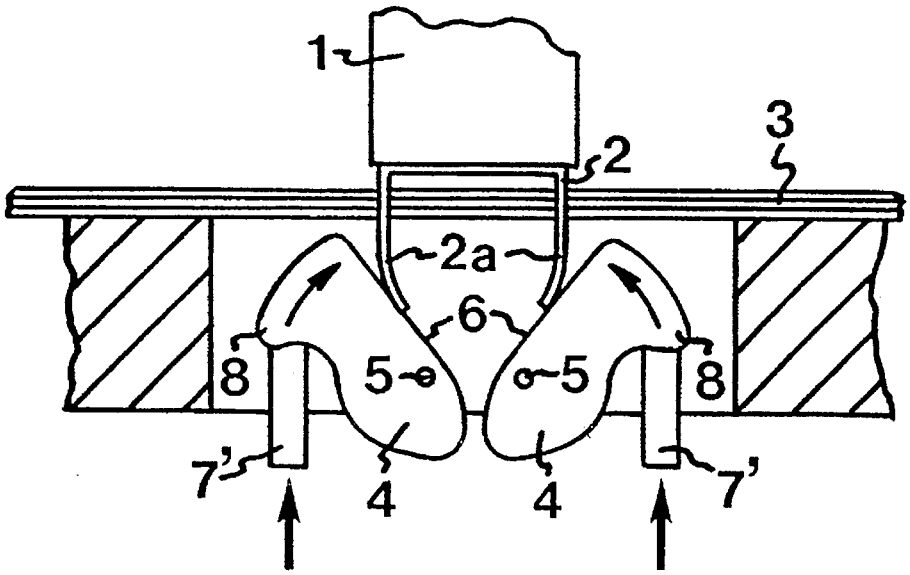
FIG. 2 is similar to FIG. 1 but shows parts of a stapler according to the invention equipped with a new type of clinching mechanism.
Figure 3:
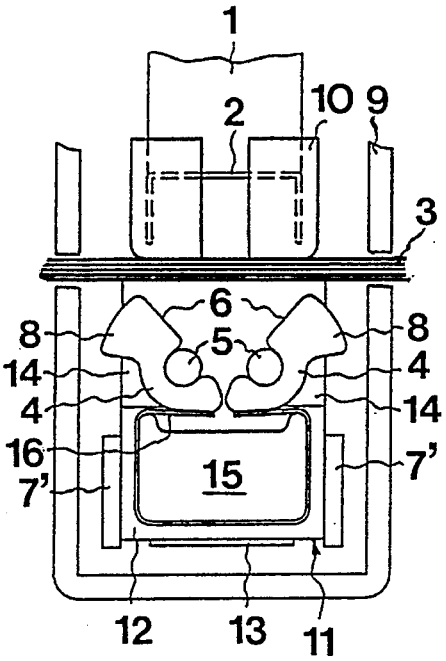
FIGS. 3–8 show another stapler according to the invention in different stapling positions.
Figure 4:
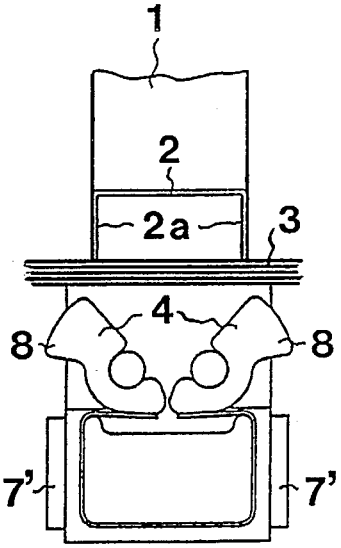
Figure 5:
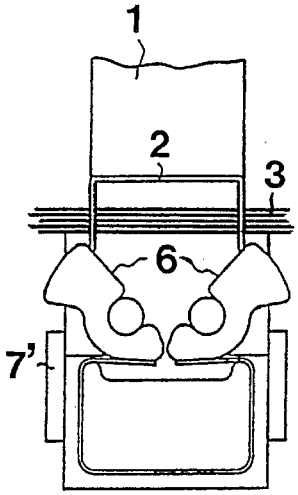

The stapler shown in FIG. 2 differs from that shown in FIG. 1 only in that it is equipped with a new type of clinching mechanism, and like parts therefore have like reference numerals in FIGS. 1 and 2. The basic difference between the new clinching mechanism used in the stapler of the invention and the clinching mechanism described-above will now be explained with reference to FIG. 2.

In FIG. 2, the stapler is shown in the same position as in FIG. 1, i.e. the position in which its drive element 1 is driving a U-shaped staple 2 into a bundle 3 of paper sheets placed in the stapler. The clinching mechanism in the stapler of FIG. 2 also has two anvil members 4 which are arranged substantially symmetrically with respect to the staple 2 and which each cooperate with a respective one of the two legs 2*a* of the staple 2 and are each pivotable about a shaft 5 perpendicular to the plane of the staple 2. In the stapler according to FIG. 2, however, the shafts 5 are located in the lower portion of the anvil members 4, and not in their upper portion, and the distance between the shafts 5 is smaller, and not greater, than the distance between the legs 2*a* of the staple 2. When the staple 2 is driven into the bundle 3 of paper sheets, its free leg ends strike on an oblique surface 6 on the respective anvil member 4, such that the staple legs 2*a* are bent slightly inwards as the staple 2 is being driven further into the bundle 3.

When the staple 2 has been driven completely into the bundle 3 of paper sheets, the anvil members 4 are swung by a respective operating member 7', which is moved upwards, about the shafts 5 in the direction of the arrows indicated within the anvil members, for bending the legs 2*a* of the staple 2 into abutment against the underside of the paper bundle 3. Also in this case, the staple 2 is bent without any curves or bulges occurring at the ends of the bent staple.

The basic difference between the known clinching mechanism of FIG. 1 and the new clinching mechanism of FIG. 2 thus resides in that the pivot shafts 5 in the known mechanism are disposed in the upper portion of the anvil members 4, whereas in the new mechanism they are disposed in the lower portion of the anvil members, that the distance between the pivot shafts in the known mechanism is greater than the distance between the staple legs, whereas in the new mechanism this distance is smaller than (or optionally equal to) the distance between the staple legs, and finally in that the anvil members in the known mechanism are pivoted towards each other below the pivot shafts and will thus engage the staple legs from below during the bending operation, whereas in the new mechanism they are pivoted towards each other above the pivot shafts so as to engage the staple legs from the side.

As appears from FIG. 2, the operating members 7' cooperate during their upward displacement with a cam 8 provided on the respective anvil member 4, for pivoting the anvil members. Each anvil member 4 will have reached its end position when its operating member 7' engages the outer side of the cam 8 with its vertical inner side, i.e. its side facing the pivot shaft 5. Continued upward displacement of the operating member 7' then produces no further pivotal movement of the anvil member 4. The operating member 7' can therefore be moved upwards a certain distance past the position of displacement in which it has brought the anvil member to its end position, and thus need not be stopped in any well-defined turning position, provided it is situated above said position of displacement. The above-discussed problem encountered in the known clinching mechanism has thus been overcome.

A stapler according to the present invention will now be described in more detail with reference to FIGS. 3–8. Like components in FIGS. 3–8, on the one hand, and in FIG. 2 on the other hand, bear like reference numerals.

The stapler according to the invention shown in FIGS. 3–8 has a fixed frame 9, a magazine 10 arranged therein, a drive element 1 and an anvil device or clinching mechanism 11 which is of the type described with reference to FIG. 2.

The magazine 10 contains U-shaped staples 2 arranged close to each other and forming a horizontal row of staples in the magazine. The drive element 1 is vertically displaceable to push the foremost staple 2 in the row of staples out of the magazine 10 to drive its legs 2*a* through a bundle 3 of paper sheets placed in the stapler.

The clinching mechanism 11 comprises a block 12 which is vertically displaceable in the frame 9 and on which the anvil members 4 described above with reference to FIG. 2 are mounted. The block 12 is vertically displaceable to permit setting its working position in the vertical direction depending on the thickness of the bundle 3 of paper sheets placed in the stapler. The block 12 is urged upwards by a spring leaf 13 and is shown in FIGS. 3–8 in a position in which it engages with its upper surface the underside of the paper bundle 3.

The pivot shafts 5 of the anvil members 4 consist of circular-cylindrical pins integrally formed with the block 12 and engage a circular-arc-shaped recess in the respective anvil member 4. Two stop lugs 14 and a substantially rectangular spring holder 15 are also integrally formed with the block 12. The stop lugs 14 define the starting position of the pivotable anvil members 4, in which the anvil members are shown in FIGS. 3–6. A spring 16 in the form of a metal wire bent into an open rectangle is mounted on the spring holder 15. At the free ends of the metal wire, the spring 16 engages the anvil members 4 for urging them into abutment against the stop lugs 14, i.e. to the starting position.

As appears from FIGS. 3–6, the clinching mechanism 11 is symmetrical with respect to the staple 2 driven into the paper bundle 3, or rather with respect to a plane P (FIG. 6) perpendicular to the plane of the staple 2 and passing through the centre thereof.

Figure 8:
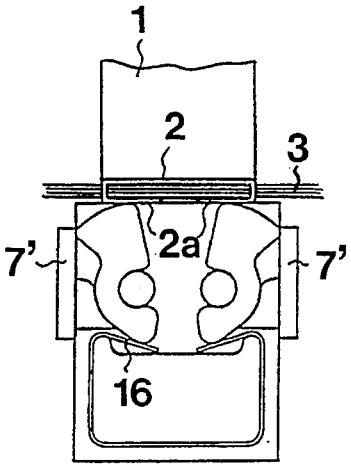

The operating members 7' are synchronously displaceable so as to be displaced upwards during a stapling operation from a lower position (FIG. 3), to an upper position (FIG. 8), thus pivoting the anvil members 4 from the starting position (FIGS. 3–6) to the end position (FIG. 8).

Figure 6:
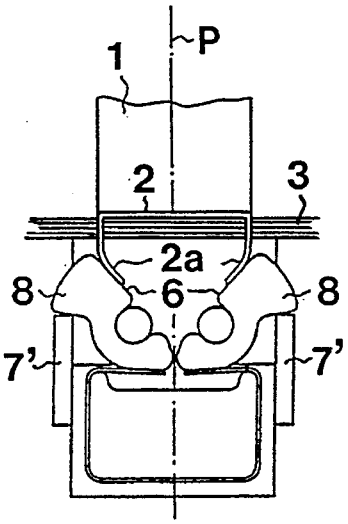
Figure 7:
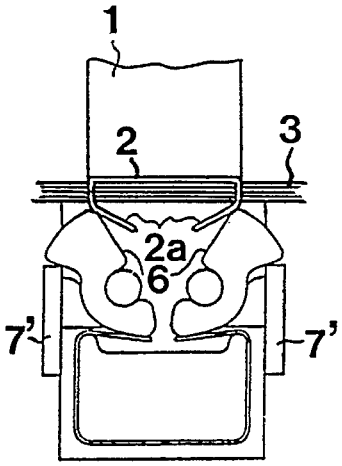

As the drive element 1 is driving the staple 2 into the bundle 3 of paper sheets, the staple legs 2*a* will encounter the anvil members 4 and be slightly bent inwards, as shown in FIG. 6, where the staple 2 has been completely driven into the bundle 3. During this driving-in of the staple 2, the operating members 7' are displaced upwards from the lower position (FIG. 3) to an intermediate position (FIG. 7), in which they have just entered into engagement with the cam 8 of the respective anvil member 4. The operating members 7' are then further displaced until they reach their upper position (FIG. 8), in which they engage with their vertical inner side the outer side of the respective cam 8 and in which the anvil members 4 are thus located in the end position. In this position, the legs 2*a* of the staple 2 engage the underside of the bundle 3 of paper sheets. Each of the anvil members 4 is so designed as to have an upper portion which, when the anvil member approaches the end position (FIG. 8), engages the staple leg 2*a* adjacent the end portion of the staple 2 in order, during the final phase of the pivotal movement of the anvil member 4, to bring about a post-compression of this staple portion. Post-compression in this portion minimises the spring-back of the staple legs 2*a* after bending.

The stapler can be modified in various ways within the scope of the invention. For example, the spring 16 may be replaced by a second cam provided on each anvil member 4 and cooperating with the respective operating member 7' to swing the anvil members 4 from the end position to the starting position. Moreover, the two anvil members 4 may be pivotable about a common axis which is perpendicular to the plane of the staple 2 and is located in the plane P, i.e. midway between the legs 2*a* of the staple 2. In such an embodiment, one anvil member may have a part-circular recess, whose centre is located on the pivot axis, while the other anvil member may have a partcircular projection which is rotatably mounted in this recess and whose centre is thus also located on the pivot axis.

I claim:

1. A stapler for driving staples into an object, comprising:

a frame;

a magazine positioned in the frame for containing at least one substantially U-shaped staple having first and second legs;

a drive element for pushing the staple out of the magazine to drive the staple into the object; and an anvil device including a first anvil member and a second anvil member, each of which is pivotable, between corresponding start and end positions, about a corresponding pivot axis extending substantially perpendicular to a plane defined by the U-shape of the staple driven into the object, the first and second anvil members being positioned such that a portion of the first anvil member located between the object and the pivot axis of the first anvil member swings toward a portion of the second anvil member located between the object and the pivot axis of the second anvil member while the first and second anvil members pivot to their end positions, said portions of the pivoting first and second anvil members respectively bending the first and second legs of the staple toward each other and substantially flush with a surface of the object.

2. A stapler as set forth in claim 1, wherein the first and second anvil members are positioned substantially symmetrically with respect to the staple driven into the object.

3. A stapler as set forth in claim 1, wherein the pivot axis of the first anvil member and the pivot axis of the second anvil member are spaced by a distance less than or equal to an initial distance between the staple legs.

4. A stapler as set forth in claim 1, further comprising operating means for pivoting the first and second anvil members from their start positions to their end positions, and wherein the first and second anvil members have respective cams that cooperate with said operating means.

5. A stapler as set forth in claim 1, further comprising:

resilient means for urging the first and second anvil members toward their start positions; and a first stop lug and a second stop lug against which the first and second anvil members abut, respectively, when in their start positions.

6. A stapler for driving staples into an object, comprising:

a frame;

a magazine positioned in the frame for containing at least one substantially U-shaped staple having first and second legs;

a drive element for pushing the staple out of the magazine to drive the staple into the object; and an anvil device including a first anvil member and a second anvil member, the first anvil member having a staple engaging surface disposed such that a free end of said first leg impinges thereon and is partially bent toward the second leg as the staple is driven into the object, the second anvil member having a staple engaging surface disposed such that a free end of said second leg impinges thereon and is partially bent toward the first leg as the staple is driven into the object, each of the first and second anvil members being pivotable, between corresponding start and end positions, about a corresponding pivot axis extending substantially perpendicular to a plane defined by the U-shape of the staple driven into the object, the first and second anvil members being positioned such that a portion of the first anvil member located between the object and the pivot axis of the first anvil member swings toward a portion of the second anvil member located between the object and the pivot axis of the second anvil member while the first and second anvil members pivot to their end positions, said portions of the pivoting first and second anvil members further bending the legs of the staple toward each other.

7. A stapler as set forth in claim 6, wherein the first and second anvil members are positioned substantially symmetrically with respect to the staple driven into the object.

8. A stapler as set forth in claim 6, wherein the first and second anvil members respectively bend the first and second legs of the staple substantially flush with a surface of the object.

9. A stapler as set forth in claim 6, wherein the pivot axis of the first anvil member and the pivot axis of the second anvil member are spaced by a distance less than or equal to an initial distance between the staple legs.

10. A stapler as set forth in claim 6, further comprising operating means for pivoting the first and second anvil members from their start positions to their end positions, and wherein the first and second anvil members have respective cams that cooperate with said operating means.

11. A stapler as set forth in claim 6, further comprising:

resilient means for urging the first and second anvil members toward their start positions; and a first stop lug and a second stop lug against which the first and second anvil members abut, respectively, when in their start positions.

* * * * *